US005664589A

United States Patent [19]

Black

[11] Patent Number: 5,664,589

[45] Date of Patent: Sep. 9, 1997

[54] HAIR ACCESSORY DEVICE MADE OF VINYL PLASTISOL

[75] Inventor: Cassie Black, Moberly, Mo.

[73] Assignee: Affect, Inc., Moberly, Mo.

[21] Appl. No.: 511,678

[22] Filed: Aug. 7, 1995

[51] Int. Cl.[6] ..... A45D 8/36

[52] U.S. Cl. ..... 132/246; 132/273

[58] Field of Search ..... 132/246, 247, 132/273

[56] References Cited

U.S. PATENT DOCUMENTS

| | | | |
|---|---|---|---|
| 1,158,957 | 11/1915 | Bates . | |
| 1,301,667 | 4/1919 | Eidt | 132/246 |
| 1,652,462 | 12/1927 | Stephens . | |
| 1,692,719 | 11/1928 | Busey . | |
| 2,490,285 | 12/1949 | Smith . | |
| 2,542,601 | 2/1951 | Van Cleef | 132/246 |
| 2,560,095 | 7/1951 | Dolphin . | |
| 2,924,228 | 2/1960 | McGee . | |
| 3,471,867 | 10/1969 | Kirchhoff . | |
| 4,834,118 | 5/1989 | Goeller | 132/246 |
| 4,892,110 | 1/1990 | Harvie . | |
| 5,165,248 | 11/1992 | Stohr | 132/246 |
| 5,499,638 | 3/1996 | Ripley | 132/246 |

FOREIGN PATENT DOCUMENTS

| | | | |
|---|---|---|---|
| 2621790 | 4/1989 | France | 132/246 |
| 3089109 | 4/1988 | Japan | 132/246 |
| 597788 | 4/1978 | Switzerland | 132/246 |
| 2116032 | 9/1983 | United Kingdom | 132/246 |

*Primary Examiner*—Todd E. Manahan
*Attorney, Agent, or Firm*—Gregory W. Osterloth

[57] ABSTRACT

The hair accessory device comprises a flexible member encased in non-celluler vinyl plastisol which is slightly soft and clingy. The flexible member comprises a wire wherein its relatively sharp ends are buried so as to create a resulting flexible member with blunt ends. In this manner, the flexible member does not poke through its vinyl plastisol casing. A method for making the hair accessory device is also disclosed.

11 Claims, 2 Drawing Sheets

HAIR ACCESSORY DEVICE MADE OF VINYL PLASTISOL

BACKGROUND OF THE INVENTION

This invention pertains to hair accessory devices, and more particularly, to decorative hair accessories which may be used to create ponytails or more unusual hair styles.

Numerous devices are known for styling hair. One common type of device comprises an elastic band which may be used to encircle a bundle of hair to create a ponytail. A problem with this device is that it must often be encircled around a bundle of hair two or three times. Once it is tightly encircled around a bundle of hair, numerous hairs tend to get caught within its circles. Consequently, it is difficult to remove the device without also removing a quantity of hair.

Other devices clip onto, or around, a bundle of hair. The most common of these devices is the barrette. A problem with these devices is that the clip is not adjustable for use with different size bundles and thicknesses of hair. As a result, a barrette may work fine with an average size bundle of medium-weight hair, but the same barrette may have too large and cumbersome of a clip to be used on a bundle of fine child's hair. The barrette may also have too small of a clip to engage a large bundle of extremely dense hair.

Another common hair accessory device comprises a flexible member which may encircle different size bundles and weights of hair. However, the majority of these devices comprise resilient, preformed elements which are only amenable to creating a limited number of hair styles.

A small number of the flexible member devices are moldable into various shapes, thus having an advantage over other devices in that they may be used to create a greater number of hair styles. These moldable devices are often called twist-ties. Twist-ties consist of a wire core which is covered with paper or fabric. Despite their styling advantages, twist-ties present many problems. A first problem is that paper and fabric coverings are subject to wrinkling and/or tearing, thus making a twist-tie unattractive after only a few uses. A second problem is that the wire core of the twist-tie has very sharp ends. Over time, the ends of the wire tend to poke through its paper or fabric covering. Not only does this result in an undesirable product which must be thrown away, but it also results in a condition which is dangerous to children and others, as the sharp wire ends can easily pierce a user's skin.

In view of the above state of the art, it is therefore a primary object of this invention to create a hair accessory device which will cling to any type or amount of hair.

It is a further object of this invention to create a hair accessory device which is not likely to be lost due to accidental disengagement from a bundle of hair to which it is attached.

It is yet another object of this invention to create hair accessory device comprising a wire core, wherein frequent use of the device will not cause the wire core to poke through the material which encases the wire.

SUMMARY OF THE INVENTION

In the achievement of the foregoing objects, the inventor has devised a hair accessory device comprising a wire, a vinyl plastisol casing for the wire, and means to bury the sharp ends of the wire before it is encased in the vinyl plastisol.

The inventor has also devised a method for making her new hair accessory device.

The above hair accessory device and method provide a solution to the afore-mentioned drawbacks of previous hair accessory devices.

The hair accessory device disclosed herein is constructed of materials which will enable it to cling to any type or amount of hair.

The "clingy"quality of the hair accessory device disclosed will also prevent it from being lost due to accidental disengagement from a bundle of hair.

Furthermore, the inventor's new hair accessory device, and method for making same, will prevent the device's wire core from poking through the device's casing.

The disclosed method also provides a means for decorating the device. Glitter, paints, dyes and other items may be used.

These and other important advantages and objectives of the present invention will be further explained in, or will become apparent from, the accompanying description, drawing and claims.

BRIEF DESCRIPTION OF THE DRAWING

Illustrative and presently preferred embodiments of the invention are illustrated in the drawing in which.

DESCRIPTION OF THE PREFERRED EMBODIMENT

Figure 1:
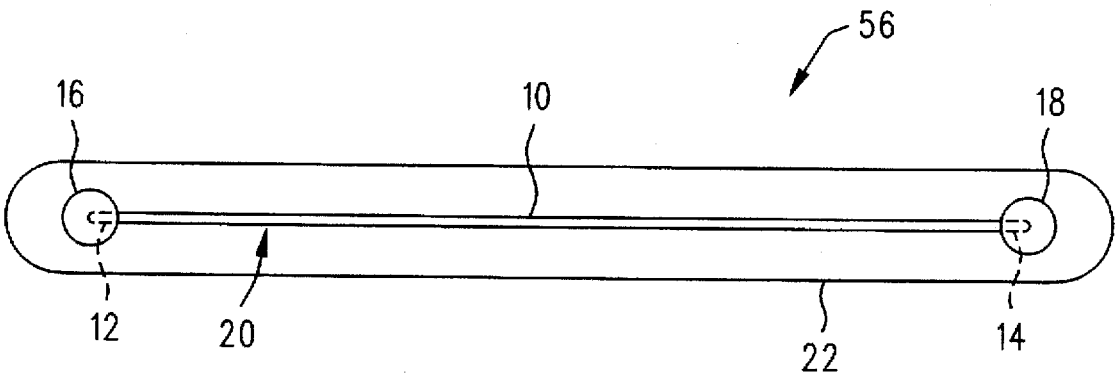
FIG. 1 is a plan view of a first preferred embodiment of a hair accessory device.
Figure 4:
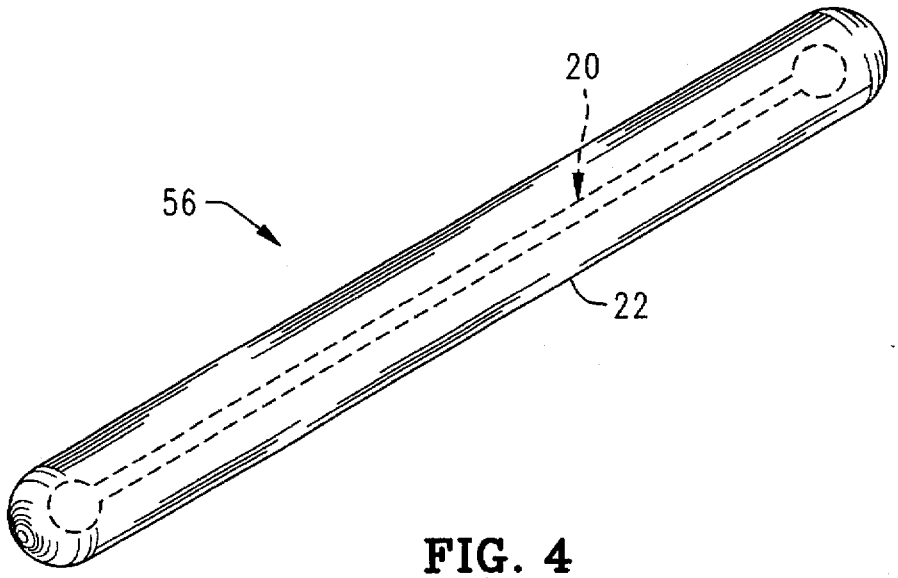
FIG. 4 is a perspective view of the hair accessory device of FIG. 1.
Figure 5:
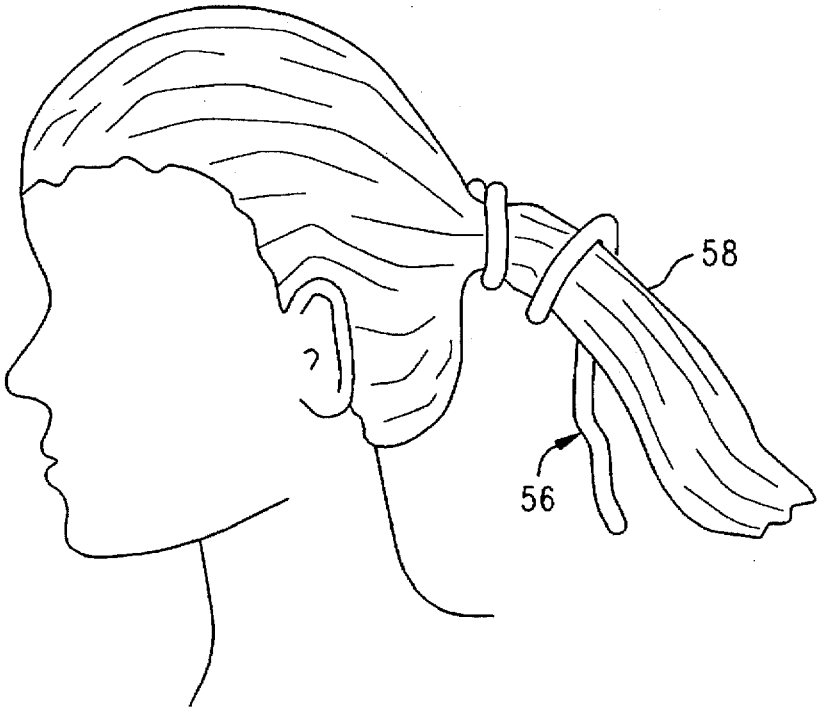
FIG. 5 shows a practical application of the hair accessory device of FIG. 1.

A hair accessory device 56 is pictured in FIGS. 1, 4 & 5, which may generally comprise a flexible member 20 having two blunt ends. The flexible member 20 is covered with a vinyl plastisol casing 22.

Having thus described the hair accessory device 56 in general, the device 56 will now be described in further detail.

In a first preferred embodiment, the hair accessory device 56 comprises a flexible member 20 encased in vinyl plastisol 22. See FIG. 1. The flexible member further comprises a wire 10 having two relatively sharp cut ends 12, 14. Each of the sharp ends 12, 14 is buried in a hard ball 16, 18. The hard balls 16, 18 may be formed from plastic or metal. The hard balls 16, 18 may be attached to the sharp wire ends 12, 14 via a melting or gluing process. Burying the wire ends 12, 14 in this way ensures that the wire 10 will not poke through the somewhat soft vinyl plastisol 22.

The wire 10 is manufactured from a steel alloy. The alloy allows the wire 10 to flex repeatedly without breaking. The wire 10 is of a sufficient strength and gauge to hold its shape when wrapped around a quantity of hair.

The vinyl plastisol 22 which encases the assembled flexible member 22 further comprises a mixture of polyvinyl chloride, plastisol, mineral oil and d.o.p. The resultant material 22 is slightly soft and "clingy"(i.e. able to frictionally adhere to other substances). The clinginess of the vinyl plastisol 22 aids in securing the hair accessory device 56 in two ways. First, it aids securing the device 56 to a quantity of hair 58 (see FIG. 5). Second, it aids in securing sections of the device 56 to itself. The clinginess of the vinyl plastisol is an important feature of the device 56 which prevents it from becoming dislodged during use, and possibly lost.

The complete device 56 may vary in length, with preferred lengths ranging from five inches to sixteen inches. The flexible member 20 may also vary in length, with preferred lengths ranging from approximately four inches to approximately fifteen inches.

The vinyl plastisol 22 covers the entirety of the flexible member 20 and is of a uniform cross section along the length of the flexible member 20. The vinyl plastisol 22 is applied to the flexible member 20 by extruding the plastisol 22 over the member 20 in an injection molding process. The thickness of the vinyl plastisol 22 casing may vary, with preferred thicknesses ranging from one-half inch for a five inch long device, to one inch for a sixteen inch long device.

Figure 2:
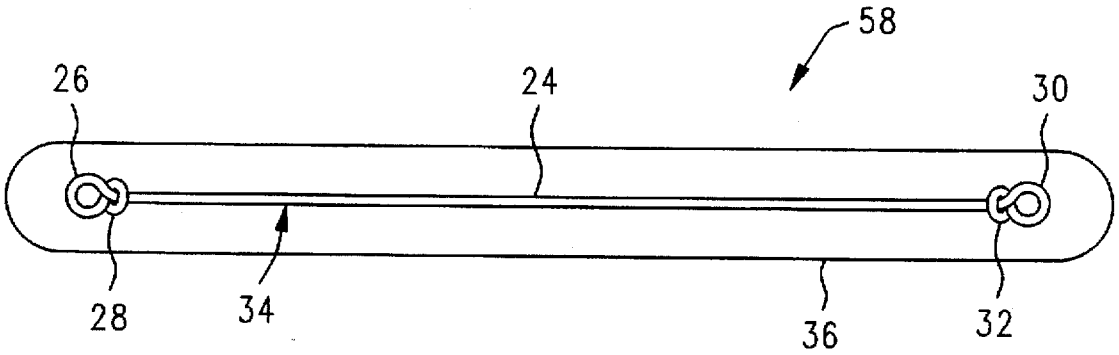
FIG. 2 is a plan view of a second preferred embodiment of a hair accessory device.

A second preferred embodiment of the hair accessory device 58 is found in FIG. 2. In this embodiment, the flexible member 34 is again encased in vinyl plastisol 36. However, the cut ends 28, 32 of the wire core 24 are buried in small nooses 26, 30 formed at each end of the wire 24. Again, the flexible member 34 will not poke through its vinyl plastisol encasing 36.

Figure 3:
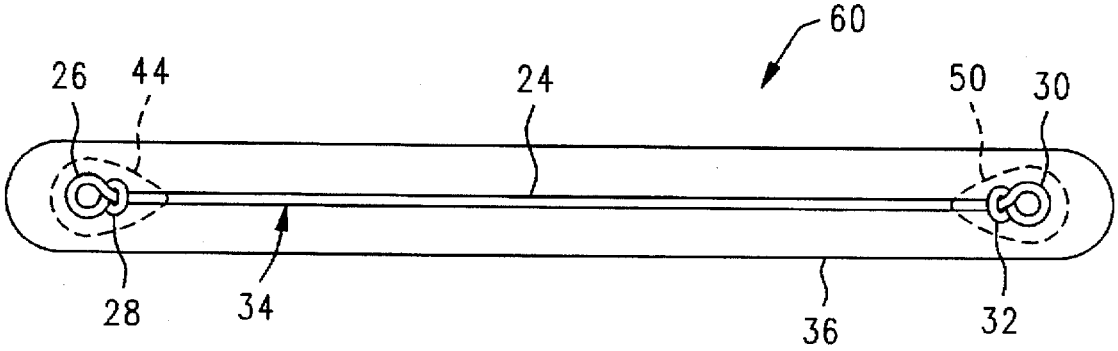
FIG. 3 is a plan view of a variation on the hair accessory device of FIG. 2.

A variation 60 of the hair accessory device 58 shown in FIG. 2 is shown in FIG. 3. In the variation 60, the nooses 26, 30 are covered in teardrops of glue 44, 50. The glue is allowed to harden before encasing the flexible member 34 in vinyl plastisol 36.

Although users of the hair accessory devices shown 56, 58, 60 will want to make use of varying lengths and widths of the device, in order to create more advanced or unusual hair styles, specific embodiments of the device are tailored to special uses. The smaller devices (those which are approximately five inches in length, and approximately one-half inch in cross-sectional diameter) are especially useful in managing the hair of small children. Their small size is also amenable to being covered with a barrette. In fact, use of the smaller hair accessory devices in conjunction with barrettes will keep barrettes from becoming accidentally dislodged from one's hair. The vinyl plastisol clings to the bundle of hair to which it is attached, and also clings to the barrett which is fastened near, or over, the hair accessory device.

For decorative purposes, the vinyl plastisol 22, 36, prior to being extruded over a flexible member 20, 34, may be died various colors and/or mixed with glitter or other small objects. The extruded plastisol 22, 36 may also be painted.

In use, the hair accessory device 56 is wrapped or twisted around a quantity of hair 58. The wire 10 may then be further bent to achieve unusual hair stylings. See FIG. 5. Alternatively, the wire 10 may be bent in some stylish form before it is used in one's hair. Due to the clingy nature of the vinyl plastisol 22, the device 56 will not become accidentally dislodged from one's hair. The only way to remove the device 56 is by unwrapping or untwisting it from one's hair.

Various hair styles may be achieved using the hair accessory device 56. One or more ponytails may be created by coiling the device around a quantity of hair. Longer versions of the device may be used to give a ponytail additional lift. Styling methods are limited only by a user's imagination.

What is claimed is:

1. A method of making a hair accessory device, comprising the steps of:

a) cutting a length of wire, thereby creating a wire with two relatively sharp ends;

b) burying the two relatively sharp wire ends, thereby creating a flexible member with blunt ends; and c) encasing the flexible member with vinyl plastisol.

2. A method of making a hair accessory device, as in claim 1, wherein the step of burying the two relatively sharp wire ends comprises the step of inserting each wire end into a ball of plastic.

3. A method of making a hair accessory device, as in claim 1, wherein the step of burying the two relatively sharp wire ends comprises the step of making a noose at each end of the wire.

4. A hair accessory device, comprising:

a) a flexible member comprising:

i) a wire with two relatively sharp ends; and ii) means for burying each of said two wire ends so as to give the flexible member two blunt ends; and b) a quantity of vinyl plastisol encasing the flexible member.

5. A hair accessory device as in claim 4, wherein the burying means comprises a noose formed at each end of the wire.

6. A hair accessory device as in claim 5, further comprising a quantity of glue covering each of the wire nooses.

7. A hair accessory device as in claim 4, wherein the burying means comprises two plastic balls and each wire end is buried in one of the plastic balls.

8. A hair accessory device as in claim 4, wherein the burying means comprises two metal balls and each wire end is buried in one of the metal balls.

9. A hair accessory device as in claim 4, wherein the vinyl plastisol encasing the flexible member has a uniform cross section along the length of the flexible member.

10. A hair accessory device as in claim 9, wherein the cross section of the vinyl plastisol is approximately one-half inch, and wherein the length of the flexible member is approximately five inches.

11. A hair accessory device as in claim 9, wherein the cross section of the vinyl plastisol is approximately one inch, and wherein the length of the flexible member is approximately sixteen inches.

* * * * *